US008561699B2

(12) United States Patent
Fitzpatrick, Jr.

(10) Patent No.: US 8,561,699 B2
(45) Date of Patent: Oct. 22, 2013

(54) WELL SCREENS HAVING ENHANCED WELL TREATMENT CAPABILITIES

(75) Inventor: Harvey J. Fitzpatrick, Jr., Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 336 days.

(21) Appl. No.: 12/966,162

(22) Filed: Dec. 13, 2010

(65) Prior Publication Data

US 2012/0145389 A1 Jun. 14, 2012

(51) Int. Cl.
*E21B 43/00* (2006.01)

(52) U.S. Cl.
USPC ..... 166/278; 166/51

(58) Field of Classification Search
USPC ..... 166/278, 282, 310, 51
See application file for complete search history.

(56) References Cited

U.S. PATENT DOCUMENTS

| | | | |
|---|---|---|---|
| 3,880,233 | A | 4/1975 | Muecke et al. |
| 4,202,411 | A | 5/1980 | Sharp et al. |
| 4,239,084 | A | 12/1980 | Sharp et al. |
| 4,284,138 | A | 8/1981 | Allred |
| 4,299,283 | A | 11/1981 | Gryskiewicz |
| 4,755,230 | A | 7/1988 | Ashton et al. |
| 5,318,119 | A | 6/1994 | Lowry et al. |
| 5,842,522 | A | 12/1998 | Echols et al. |
| 5,931,232 | A | 8/1999 | Echols et al. |
| 6,062,307 | A | 5/2000 | Hamid et al. |
| 6,140,277 | A | 10/2000 | Tibbles et al. |
| 6,211,120 | B1 | 4/2001 | Welch et al. |
| 6,342,467 | B1 | 1/2002 | Chang et al. |
| 6,394,185 | B1 | 5/2002 | Constien |

(Continued)

FOREIGN PATENT DOCUMENTS

| | | | |
|---|---|---|---|
| EP | 1741773 | A1 | 1/2007 |
| GB | 2365043 | A | 2/2002 |

(Continued)

OTHER PUBLICATIONS

International Search Report with Written Opinion issued Jul. 20, 2012 for PCT Patent Application No. PCT/US11/063517, 10 pages.

(Continued)

*Primary Examiner* — William P Neuder
(74) *Attorney, Agent, or Firm* — Smith IP Services, P.C.

(57) ABSTRACT

A well screen assembly with enhanced well treatment capabilities. A well screen assembly can include a well treatment substance secured to the well screen assembly, and at least one reactive component of a well treatment stimulant. The reactive component can also be secured to the well screen assembly. A method of treating a well can include expanding a well screen assembly outward in a wellbore of the well, thereby decreasing a distance between a well treatment substance and a wall of the wellbore. Another method of treating a well can include contacting multiple reactive components of a well treatment stimulant with each other in the well, thereby dispersing a well treatment substance about a well screen assembly.

38 Claims, 8 Drawing Sheets

(56) References Cited

U.S. PATENT DOCUMENTS

| | | | | |
|---|---|---|---|---|
| 6,527,051 | B1 | 3/2003 | Reddy et al. | |
| 6,569,814 | B1 | 5/2003 | Brady et al. | |
| 6,638,896 | B1 | 10/2003 | Tibbles et al. | |
| 6,776,241 | B2 | 8/2004 | Castano-Mears et al. | |
| 6,831,044 | B2 | 12/2004 | Constien | |
| 7,360,593 | B2 | 4/2008 | Constien | |
| 7,624,743 | B2 | 12/2009 | Sarkar et al. | |
| 7,708,068 | B2 * | 5/2010 | Hailey, Jr. | 166/278 |
| 8,261,824 | B2 * | 9/2012 | Bismarck et al. | 166/276 |
| 2002/0142919 | A1 | 10/2002 | Constien | |
| 2003/0131997 | A1 | 7/2003 | Chatterji et al. | |
| 2005/0065037 | A1 | 3/2005 | Constien | |
| 2007/0187090 | A1 | 8/2007 | Nguyen et al. | |
| 2008/0139416 | A1 | 6/2008 | Rimassa et al. | |
| 2008/0196879 | A1 | 8/2008 | Broome et al. | |
| 2009/0025932 | A1 | 1/2009 | Panga et al. | |
| 2009/0065206 | A1 | 3/2009 | Russell | |

FOREIGN PATENT DOCUMENTS

| | | | |
|---|---|---|---|
| GB | 2412389 | A | 9/2005 |
| GB | 2449021 | A | 11/2008 |
| WO | 9717524 | A2 | 5/1997 |
| WO | 0134939 | A1 | 5/2001 |
| WO | 2005088064 | A1 | 9/2005 |

OTHER PUBLICATIONS

Baker Hughes; "Sand Control Screen Technologies", Publication No. BOT-08-23062 1M, dated Dec. 2008, 12 pages.

C&C Reactive Coatings; "Chemical and Process Know-How for use of Reactive Coatings on Sand Control Screens", dated Jan. 28, 2011, 42 pages.

Darcy, "The Darcy Difference—Potential Operation", Online Brochure, undated, 7 pages.

Halliburton, "SureTherm Service for Paraffin Removal", H07615, dated Apr. 2010, 2 pages.

Halliburton, "PetroGuard Advanced Mesh Screen", H05732, dated Aug. 2007, 2 pages.

Halliburton, "PetroGuard Swell and PetroGuard Treat Screen Product Overview", Product Presentation, dated 2009, 3 pages.

Halliburton, "SureTherm", Product Presentation, Pump Up the Volume Halliburton Academy 2009, dated 2009, 12 pages.

Halliburton, "PetroGuard Swell", Product Presentation, dated 2010, 5 pages.

Weatherford, "ESS Expandable Sand Screens Achieve Neutral Skin in Deep, Hot, and Corrosive Gas Well After Three-Year Shutdown", Publication No. 5967.00, dated 2008, 2 pages.

* cited by examiner

FIG.2A
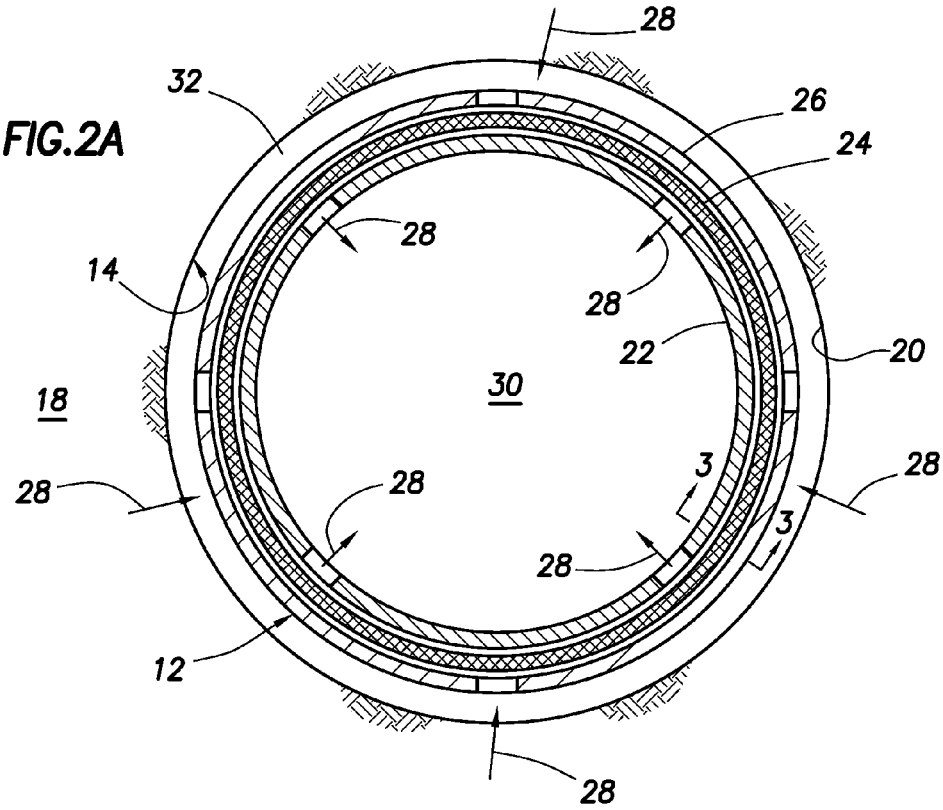
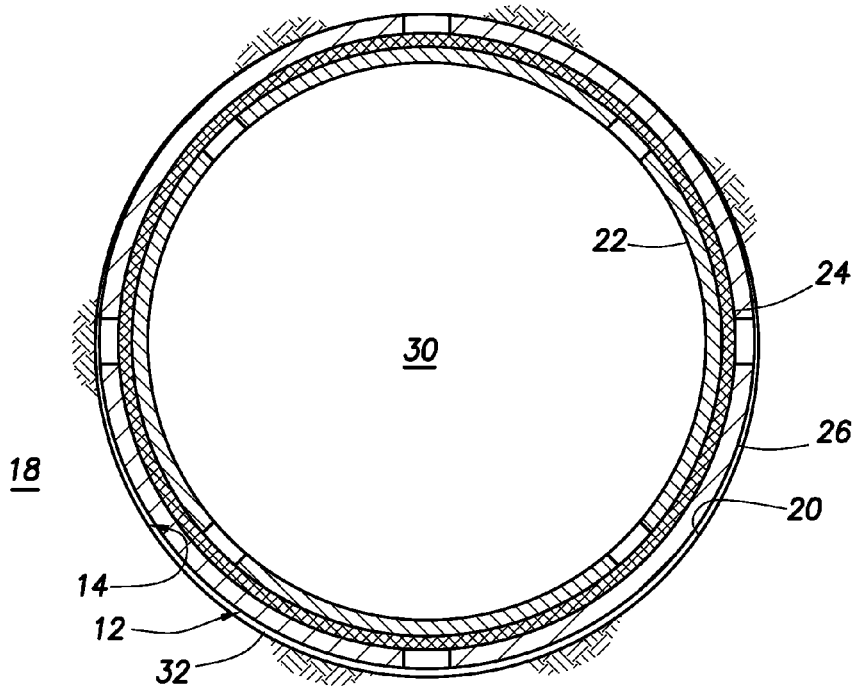
FIG.2B

WELL SCREENS HAVING ENHANCED WELL TREATMENT CAPABILITIES

BACKGROUND

This disclosure relates generally to equipment utilized and operations performed in conjunction with a subterranean well and, in an example described below, more particularly provides a well screen assembly with enhanced well treatment capabilities.

Various compositions can be used to treat a well in order to remove or dissolve a mud cake on the wall of a wellbore, to increase permeability in the near-wellbore region of a formation intersected by the wellbore, etc. It will be appreciated that improved results could be obtained if enhanced methods of delivering the compositions into more intimate contact with the wellbore wall could be developed.

Therefore, it will also be appreciated that improvements are needed in the art of well treatment.

SUMMARY

In the disclosure below, systems and methods are provided which bring improvements to the art of well treatment. One example is described below in which a well treatment substance is displaced closer to a wellbore wall by expansion of a well screen assembly. Another example is described below in which a well treatment stimulant is used to disperse the well treatment substance.

In one aspect, the present disclosure provides to the art a well screen assembly. The well screen assembly can include a well treatment substance secured to the well screen assembly, and at least one reactive component of a well treatment stimulant. The reactive component can also be secured to the well screen assembly.

In another aspect, the disclosure provides a method of treating a well. The method can include expanding a well screen assembly outward in a wellbore of the well, thereby decreasing a distance between a well treatment substance and a wall of the wellbore.

In yet another aspect, a method of treating a well is provided, with the method comprising the step of contacting multiple reactive components of a well treatment stimulant with each other in the well, thereby dispersing a well treatment substance about a well screen assembly.

These and other features, advantages and benefits will become apparent to one of ordinary skill in the art upon careful consideration of the detailed description of representative examples below and the accompanying drawings, in which similar elements are indicated in the various figures using the same reference numbers.

BRIEF DESCRIPTION OF THE DRAWINGS

FIGS. 2A & B are enlarged scale representative cross-sectional views through a well screen assembly, taken along line 2-2 of FIG. 1.

DETAILED DESCRIPTION

Figure 1:
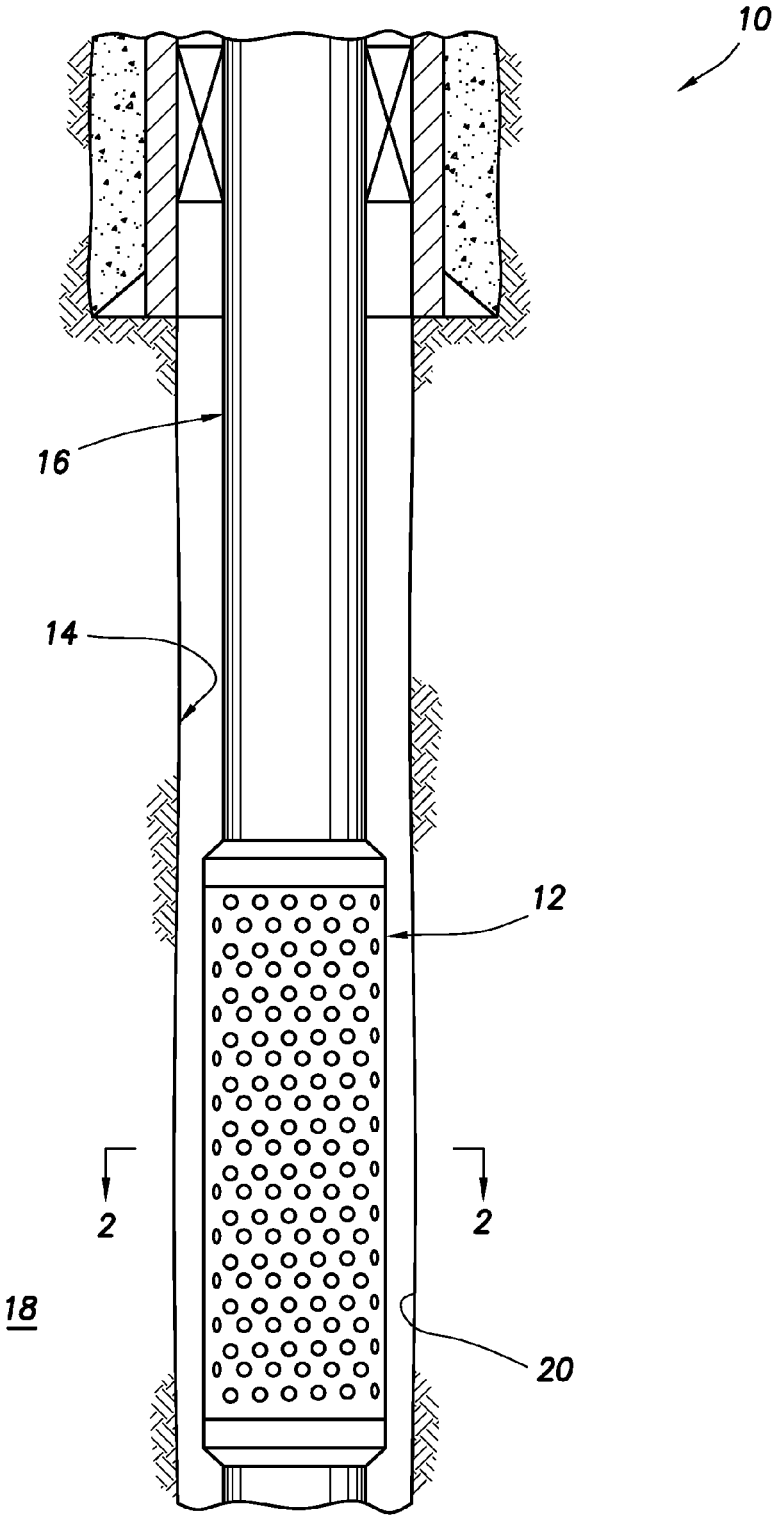
FIG. 1 is a representative partially cross-sectional view of a well system and associated method which can embody principles of the present disclosure.

Representatively illustrated in FIG. 1 is a well system 10 and associated method which can embody principles of this disclosure. In the well system 10, a well screen assembly 12 is installed in a wellbore 14. The screen assembly 12 is interconnected as part of a tubular string 16 for production of fluids to the surface from a formation 18 surrounding the wellbore 14.

Although a production operation is depicted in FIG. 1 for the well system 10, it should be understood that the principles of this disclosure are also applicable to injection or other types of well operations. Although the wellbore 14 is depicted in FIG. 1 as being uncased or "open hole," it should be understood that the screen assembly 12 could be installed in a cased or lined wellbore in other examples. It is also not necessary for the tubular string 16 to be configured as shown in FIG. 1, or for the screen assembly 12 to be interconnected in a tubular string at all.

Therefore, it should be clearly understood that the principles of this disclosure are not limited to any details of the well system 10 illustrated in FIG. 1 or described herein. Instead, a large variety of possible well system configurations and methods can incorporate the principles of this disclosure, and the well system 10 of FIG. 1 is merely one example, which is used for the purpose of illustrating those principles.

In one important feature of the screen assembly 12 of FIG. 1, a well treatment substance is incorporated into the screen assembly, so that the well treatment substance is conveyed into the wellbore 14 with the screen assembly. In various examples, the well treatment substance could be incorporated into a base pipe, an outer shroud, a filter portion, an annular area between these or other components, other areas in the screen assembly 12, etc.

Suitable well treatment substances for use in the well system 10 include those described in U.S. Pat. Nos. 7,360,593, 6,831,044 and 6,394,185, and in U.K. Publication No. GB2365043, the entire disclosures of which are incorporated herein by this reference. Other types of well treatment substances may be used, if desired. Preferably, the well treatment substance is effective to dissolve a mud cake on a wall 20 of the wellbore 14 and in the near-wellbore region of the formation 18, and preferably the well treatment substance is effective to increase a permeability of the formation, at least in the near-wellbore region.

In one example, the screen assembly 12 is expanded radially outward in the wellbore 14, thereby also displacing the well treatment substance closer to the wellbore wall 20 (and, thus, closer to any mud cake on the wellbore wall). This can be advantageous for promoting contact between the well treatment substance and the wall 20 of the wellbore 14, or at least decreasing the distance between the well treatment substance and the wellbore wall to enhance effectiveness of the treatment.

In another example, at least one reactive component of a well treatment stimulant is also carried with the screen assembly 12 into the wellbore 14. The one or more reactive components could, for example, be included with the well treatment substance in a coating applied to the interior, exterior and/or in the sidewall of the screen assembly 12. In this manner, the well treatment stimulant is in close proximity to the well treatment substance for effective stimulation of the well treatment.

The well treatment stimulant can enhance the well treatment reaction in various ways. For example, when reactive components of the stimulant are placed in contact with each other, gas and/or heat may be produced. The gas can promote dispersing of the well treatment substance, so that it more readily and completely reacts with the mud cake surrounding the screen assembly 12. The heat can increase the rate of the reaction(s) by which the well treatment substance dissolves the mud cake, increases the near-wellbore permeability of the formation 18, etc.

One suitable well treatment stimulant results from a reaction between $NaNO_2$ (sodium nitrite) and $NH_4Cl$ (ammonium chloride). The products of this reaction include heat and nitrogen gas. Another suitable well treatment stimulant is marketed by Halliburton Energy Services, Inc. of Houston, Tex. USA as SURETHERM™ for cleaning pipelines.

If multiple components of the well treatment stimulant are included in a coating, then the components can contact and react with each other when a matrix material of the coating is dissolved. The coating matrix material can be dissolved by any means, including but not limited to, contact with water, acid, etc., pH adjustment, heat, passage of time, or any other means.

If a fluid (or a slurry of carrier fluid and solids entrained in the carrier fluid) is circulated to the screen assembly 12 to dissolve the coating matrix material, one of the reactive components of the well treatment stimulant can be included with the fluid. In this way, the reactive components (in the coating, and in the circulated fluid) can come into contact with each other and react concurrently with the well treatment substance being released from the coating.

Referring additionally now to FIGS. 2A & B, enlarged scale cross-sectional views of the screen assembly 12 in the wellbore 14 are representatively illustrated. This example of the screen assembly 12 includes an inner base pipe 22, a filter portion 24 and an outer shroud 26.

The screen assembly 12 filters fluid 28 which flows from the formation 18 into an inner passage 30 of the screen assembly for production to the surface via the tubular string 16. In injection operations, the fluid 28 would flow in the opposite direction.

As described more fully below, the well treatment substance and/or one or more reactive components of the well treatment stimulant may be incorporated into or otherwise secured to the screen assembly 12, so that they are installed together in the wellbore 14. The well treatment substance and/or reactive component(s) of the well treatment stimulant may, for example, be applied to interior and/or exterior surfaces of the base pipe 22, filter portion 24 and/or outer shroud 26, disposed between or within any of these elements of the screen assembly, etc. Thus, any location of the well treatment substance and/or reactive component(s) of the well treatment stimulant relative to the elements of the screen assembly 12 may be used in keeping with the principles of this disclosure.

The filter portion 24 is schematically depicted in FIGS. 2A & B as a single element, but it should be understood that any number of filter portions may be used, and a single filter portion may comprise any number of individual components or layers, if desired. The filter portion 24 may comprise wire mesh, sintered, wire wrapped, pre-packed, or any other type of filtering elements, and any number or combination of filtering elements.

Note that the base pipe 22, filter portion 24 and outer shroud 26 are depicted in FIGS. 2A & B as merely one example of elements which can be included in a screen assembly. This combination of elements is not necessary in a screen assembly which embodies principles of this disclosure. For example, it is not necessary for the screen assembly 12 to include the outer shroud 26, etc.

In the configuration of FIG. 2A, an annulus 32 is formed radially between the screen assembly 12 and the wellbore wall 20. However, in FIG. 2B, screen assembly 12 has been radially outwardly expanded, so that the annulus 32 is eliminated, or at least substantially reduced.

Expansion of the screen assembly 12 brings the well treatment substance into much closer proximity to, and possibly into direct contact with, the wall 20 of the wellbore 14. If one or more reactive components of the well treatment stimulant are also included in the screen assembly 12, then the component(s) may also be brought into closer proximity to the wellbore wall 20 by expansion of the screen assembly.

Note that it is not necessary in keeping with the principles of this disclosure for the screen assembly 12 to be expanded. Instead, those principles could also be practiced, even if the screen assembly 12 remains in its configuration as depicted in FIG. 2A.

Figure 3:
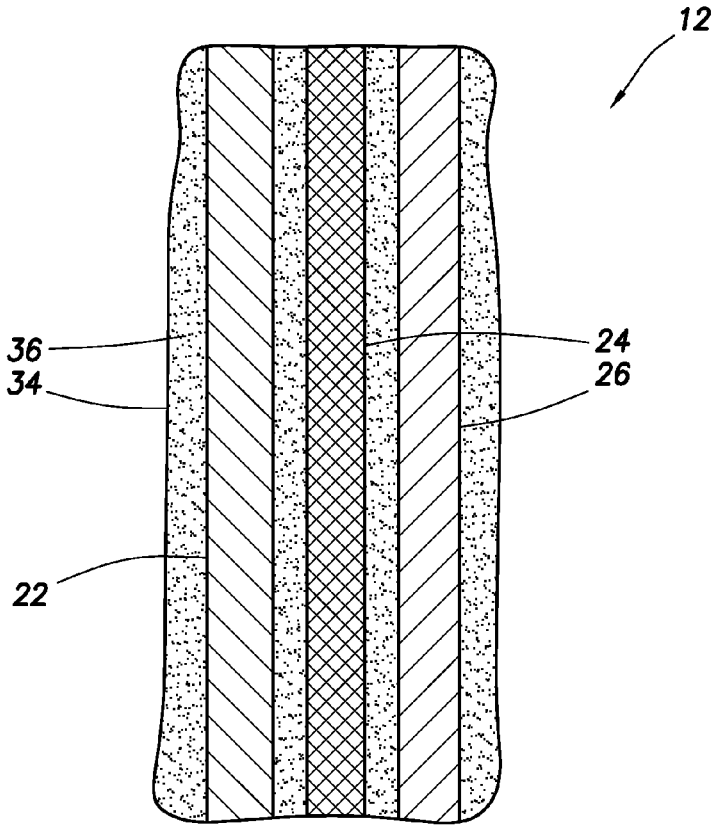
FIG. 3 is a further enlarged scale representative cross-sectional view of one side of the well screen assembly, taken along line 3-3 of FIG. 2A.

Referring additionally now to FIG. 3, an enlarged scale longitudinal cross-section of one side of the screen assembly 12 is representatively illustrated. In this view, it may be seen that a coating 34 is applied to inner and outer surfaces of the base pipe 22, filter portion 24 and outer shroud, and fills any annular spaces between these elements.

One advantage to using the coating 34 is that it can prevent plugging of the filter portion 24 during installation and expansion of the screen assembly 12 in the wellbore 14, but a matrix material 36 of the coating can then be readily dissolved when or after the screen assembly is installed and expanded. Dissolving of the matrix material 36 can release the well treatment substance and/or release one or more reactive components of the well treatment stimulant. The dissolving step may be performed before, during and/or after expanding the well screen assembly 12.

Figure 4A:
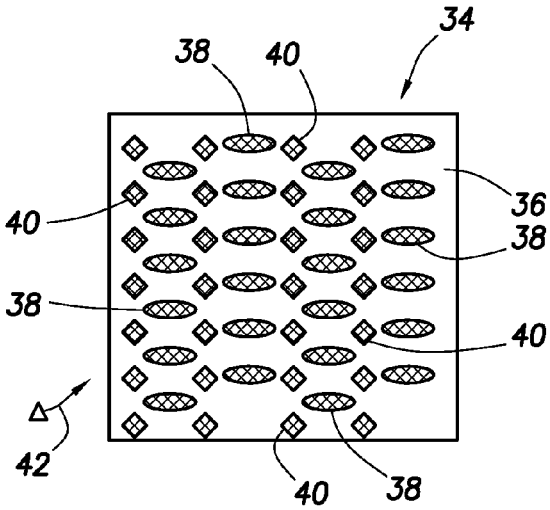
FIGS. 4A & B are further enlarged scale representative views of a coating on the well screen assembly.

Referring additionally now to FIGS. 4A & B, enlarged scale schematic views of the coating 34 are representatively illustrated. In FIG. 4A, the coating comprises at least the well treatment substance 38 in the matrix material 36.

At least one reactive component 40 of the well treatment stimulant may also be incorporated into the coating 34, if desired. When the matrix material 36 is dissolved, the well treatment substance 38 and the reactive component 40 of the well treatment stimulant are released.

Preferably, another reactive component 42 of the well treatment stimulant would be included in the fluid circulated to the screen assembly 12 to dissolve the matrix material 36. For example, $NaNO_2$ (sodium nitrite) could be included in the coating 34, and $NH_4Cl$ (ammonium chloride) could be circulated with the fluid when the matrix material 36 is to be dissolved.

Figure 4B:
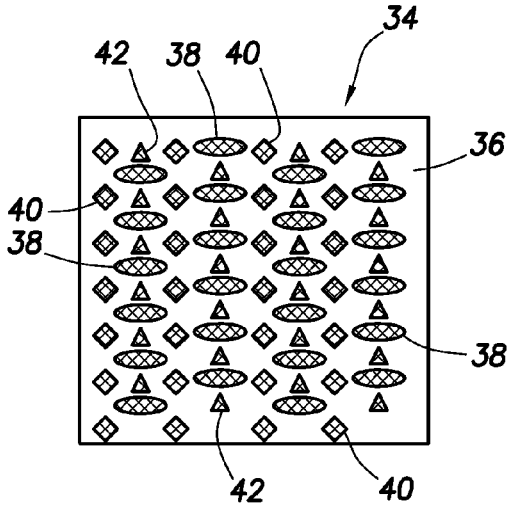

In the configuration of FIG. 4B, both reactive components 40, 42 of the well treatment stimulant are included in the coating 34, along with the well treatment substance 38. In this way, when the matrix material 36 is dissolved, the reactive components 40, 42 can contact each other when they are released from the matrix material, along with the well treatment substance 38.

Figure 5:
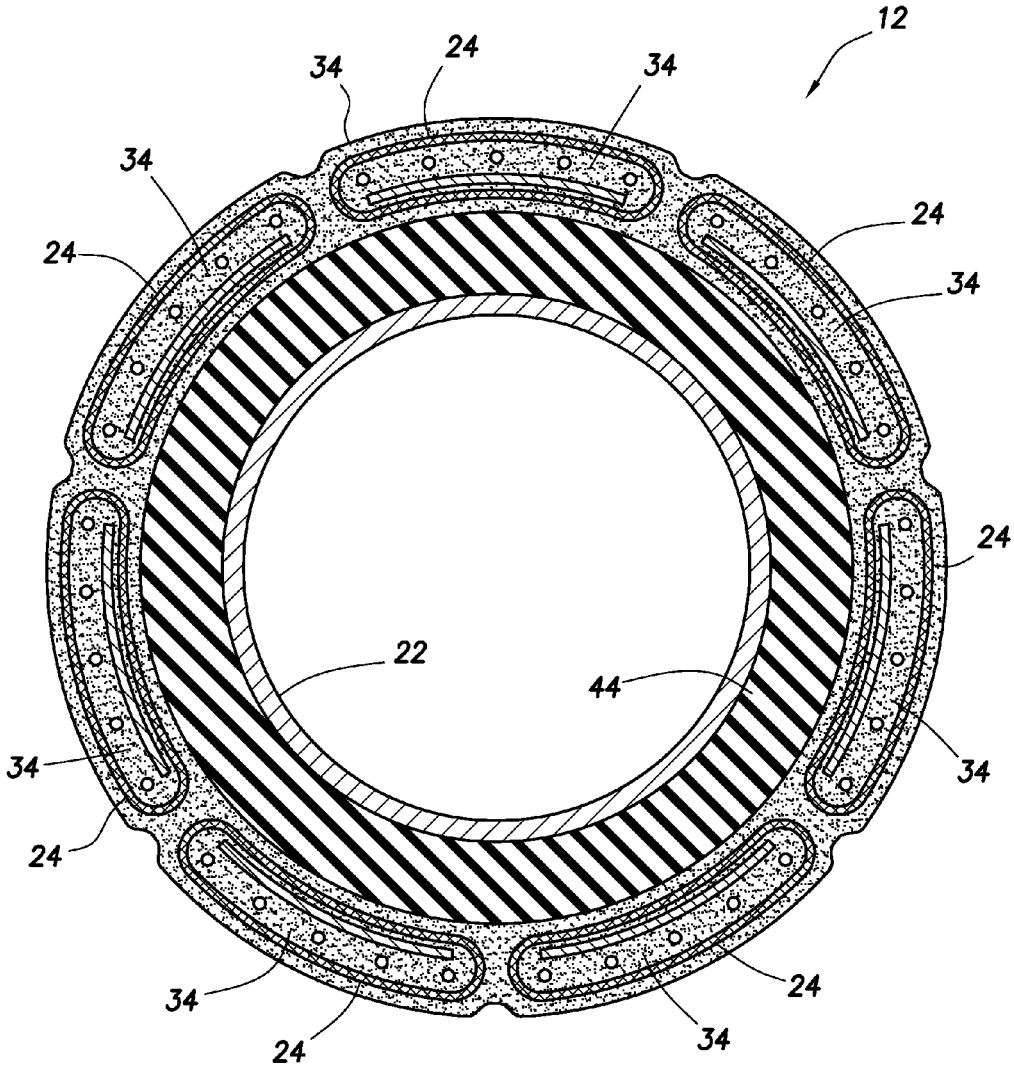
FIGS. 5-9 are representative cross-sectional views of additional configurations of the well screen assembly.

Referring additionally now to FIG. 5, another configuration of the expandable well screen assembly 12 is representatively illustrated. In this example, separate longitudinally extending filter portions 24 are extended radially outward in a well when an annular swellable material 44 on the base pipe 22 swells in response to contact with a particular fluid (which may or may not be the same fluid as the fluid 28). Such expandable well screens may be known as "swell expandable screens."

The coating 34 can fill any void spaces in the filter portions 24, and/or between the filter portions, can coat the outside of the filter portions, etc. The well treatment substance 38, reactive component 40 and/or reactive component 42 can be included in the coating 34.

Figure 6:
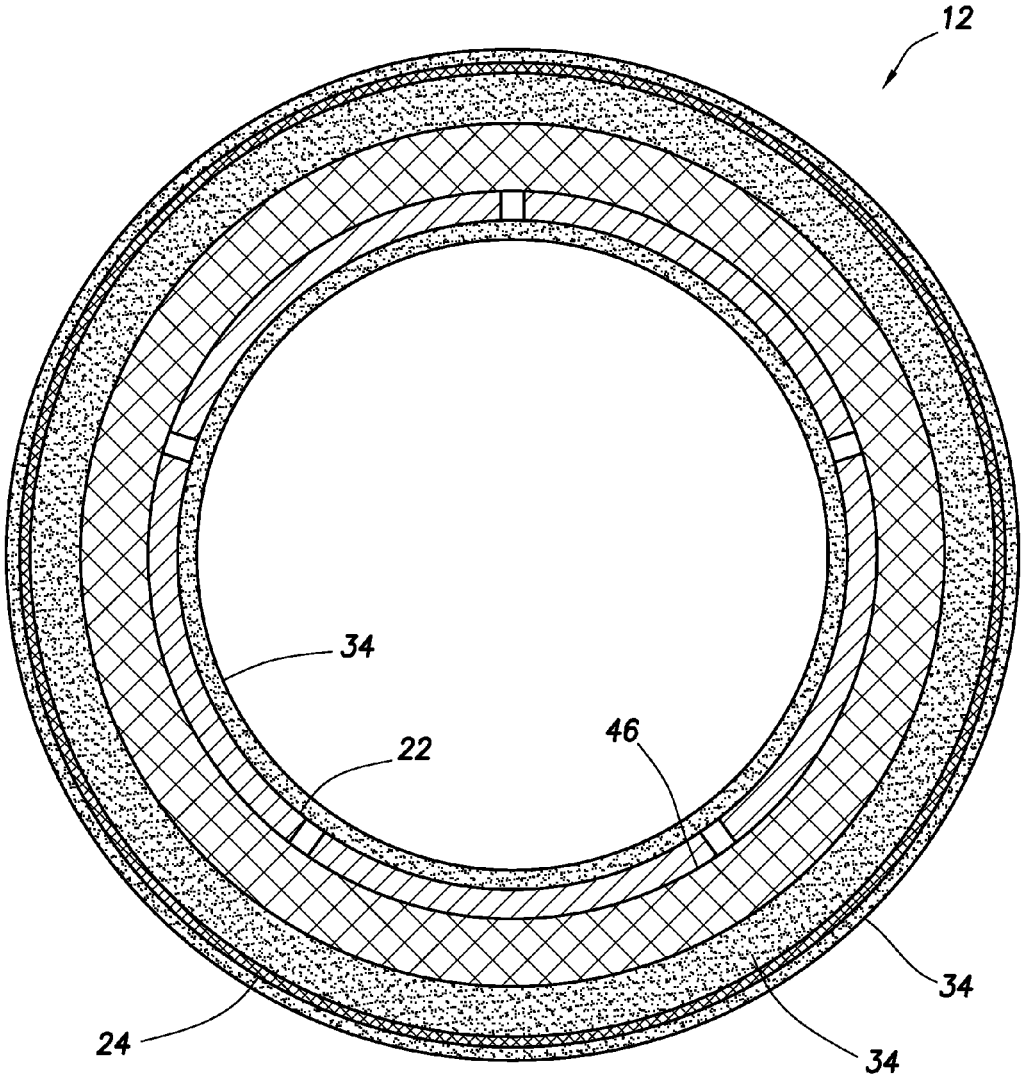

Referring additionally now to FIG. 6, another configuration of the expandable well screen assembly 12 is representatively illustrated. In this example, the filter portion 24 comprises a shape memory polymer foam expanding porous media, of the type marketed by Baker Hughes, Inc. The filter portion 24 expands radially outward in response to elevated downhole temperature.

The coating 34 (comprising the well treatment substance 38, reactive component 40 and/or reactive component 42) can fill any void spaces in the porous foam filter portion 24, outside of the filter portion and/or in a drainage layer 46 disposed radially between the base pipe 22 and the filter portion 24. The coating 34 can coat the exterior and/or interior of the well screen assembly 12.

Figure 7:
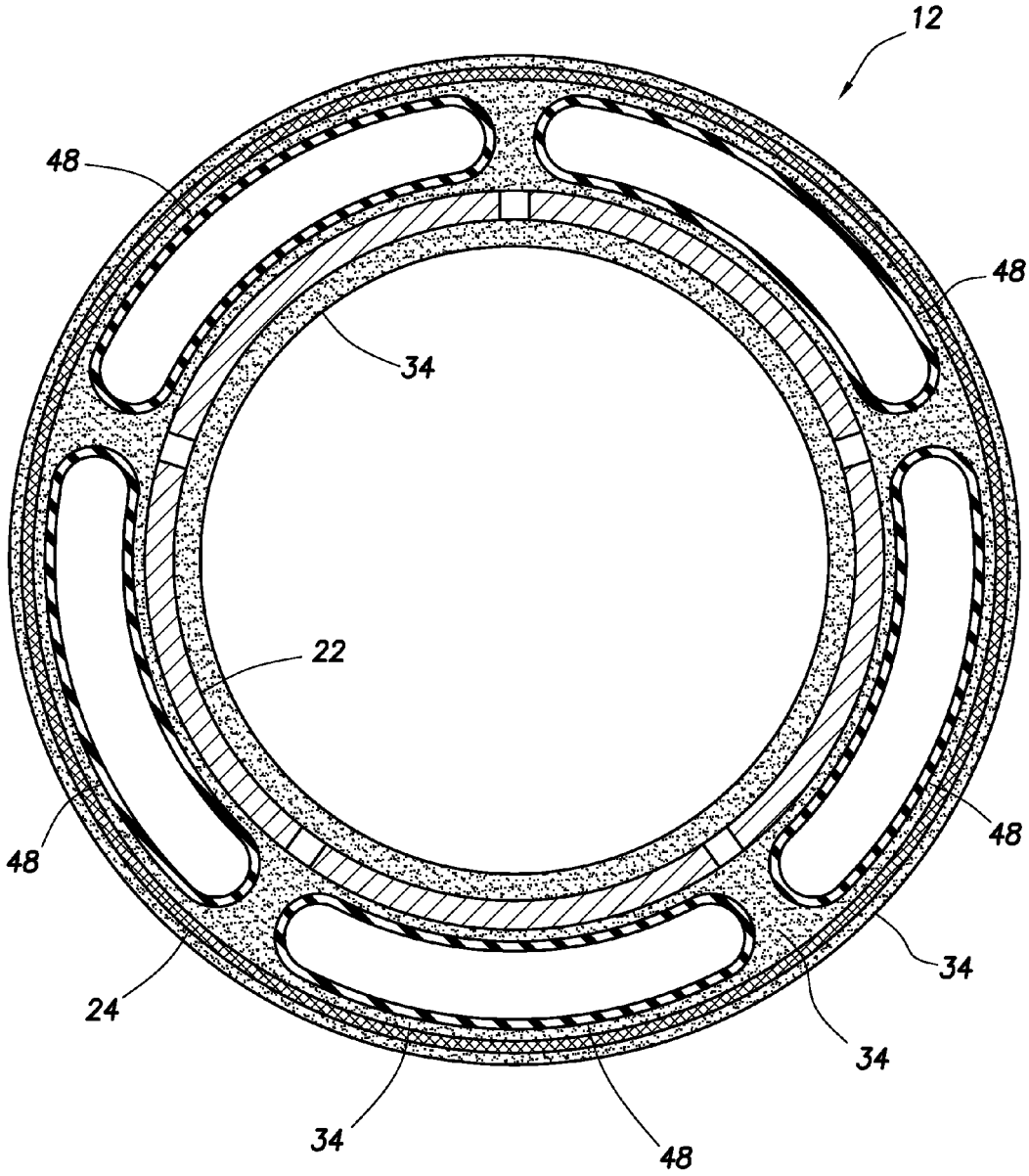

Referring additionally now to FIG. 7, another configuration of the well screen assembly 12 is representatively illustrated. In this configuration, inflation tubes 48 are positioned radially between the filter layer 24 and the base pipe 22. When the tubes 48 are inflated, the filter portion 24 is extended outward.

The coating 34 (comprising the well treatment substance 38, reactive component 40 and/or reactive component 42) can fill any void spaces in the filter portion 24, outside of the filter portion and/or about the inflation tubes 48 between the base pipe 22 and the filter portion 24. The coating 34 can coat the exterior and/or interior of the well screen assembly 12.

Figure 8:
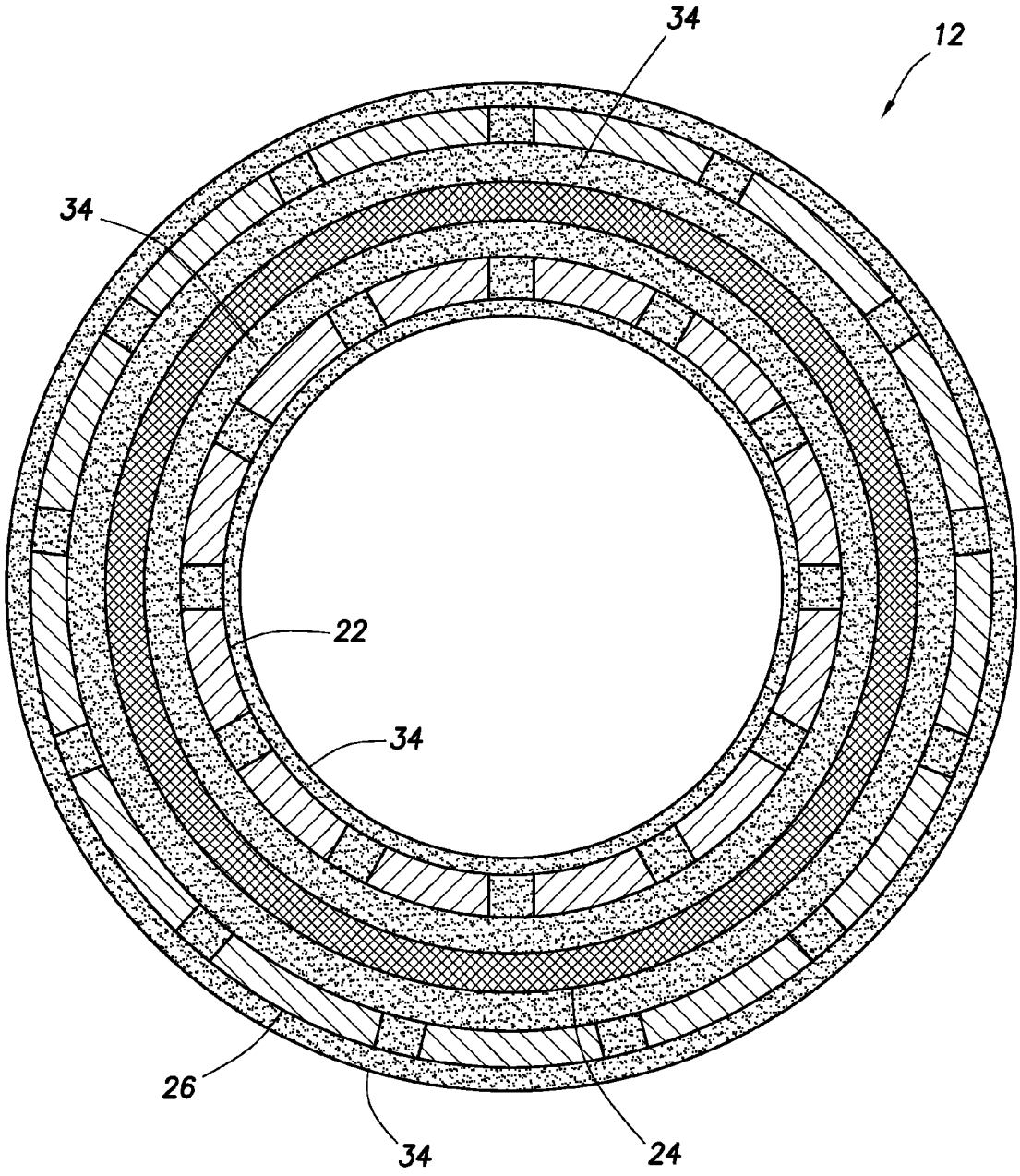

Referring additionally now to FIG. 8, another configuration of the well screen assembly 12 is representatively illustrated. The well screen assembly 12 depicted in FIG. 8 is similar in many respects to a well screen marketed as the ESS™ by Weatherford International, Inc. of Houston, Tex. USA, although some proportions (such as gaps between the outer shroud 26, filter portion 24 and base pipe 22, etc.) have been exaggerated for illustrative clarity.

In this configuration, the base pipe 22 comprises a slotted or perforated expandable liner, and the outer shroud 26 is slotted for ease of expansion. The filter portion 24 may comprise a mesh filter material.

The coating 34 can fill any void spaces in the filter portion 24, gaps between the filter portion and the base pipe 22 and/or outer shroud 26. The coating can coat the exterior and/or interior of the well screen assembly 12.

Figure 9:
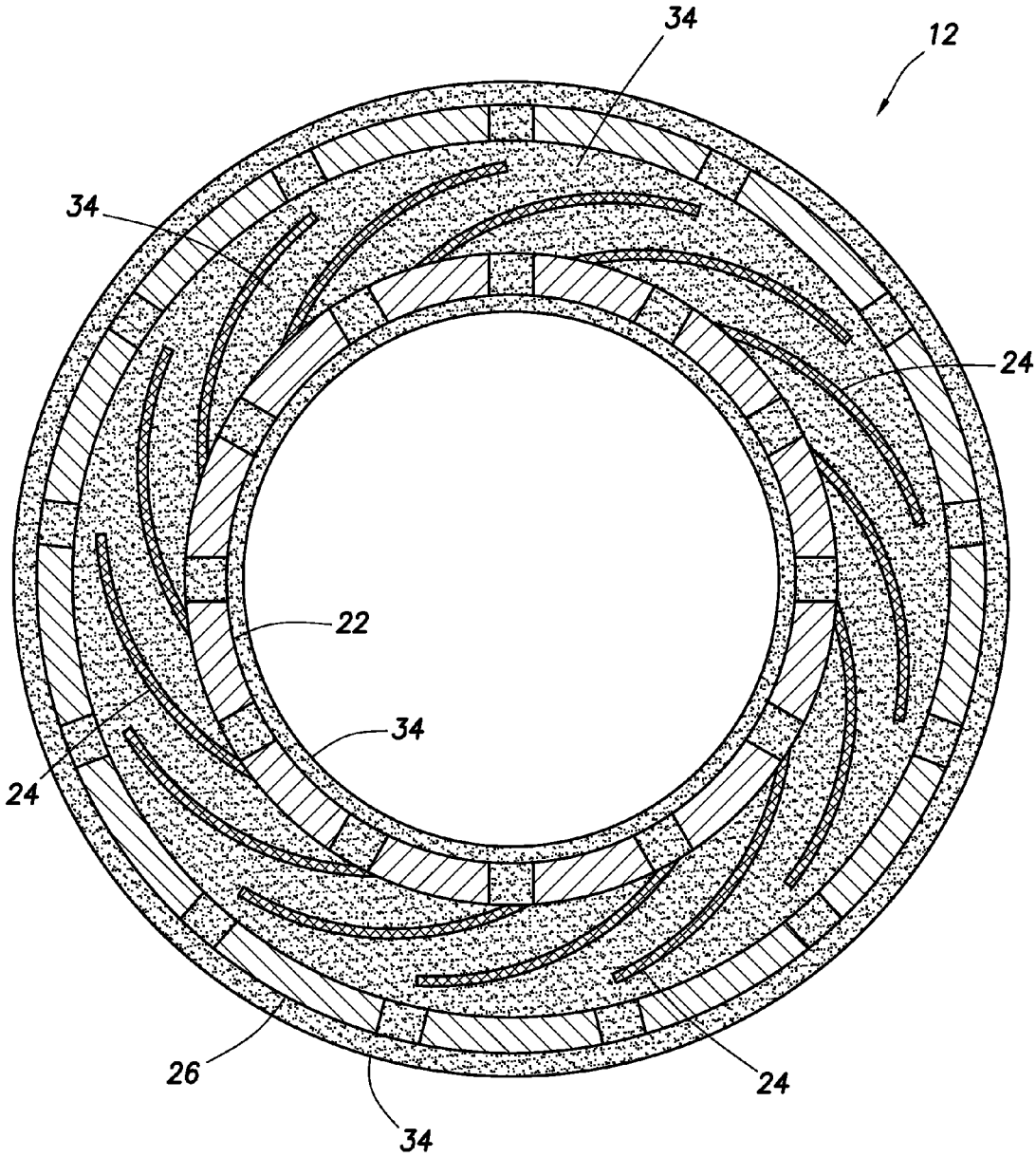

Referring additionally now to FIG. 9, another configuration of the well screen assembly 12 is representatively illustrated. The well screen assembly 12 depicted in FIG. 9 is similar in many respects to a well screen marketed as the EXPress™ by Baker Oil Tools, Inc. of Houston, Tex. USA, although some proportions (such as gaps between the outer shroud 26, filter portion 24 and base pipe 22, etc.) have been exaggerated for illustrative clarity.

In this configuration, the base pipe 22 comprises a slotted or perforated expandable liner, and the outer shroud 26 is slotted for ease of expansion. The filter portion 24 may comprise multiple overlapping leaves made of a mesh filter material.

The coating 34 can fill any void spaces in the filter portion 24, gaps between the filter portion and the base pipe 22 and/or outer shroud 26. The coating can coat the exterior and/or interior of the well screen assembly 12.

It may now be fully appreciated that the present disclosure provides several advancements to the art of well treatment. The well treatment stimulant can promote more effective treatment by the well treatment substance, whether or not the screen assembly is expanded. If used in an expandable screen assembly, the well treatment substance can more effectively treat the well, even if the well treatment stimulant is not provided.

The above disclosure provides to the art an improved well screen assembly 12. The screen assembly 12 can include a well treatment substance 38 secured to the well screen assembly 12, and at least one reactive component 40 of a well treatment stimulant, with the reactive component 40 also being secured to the well screen assembly 12.

The well treatment substance 38 and the reactive component 40 can be incorporated into a coating 34 applied to the well screen assembly 12. A matrix material 36 of the coating 34 may isolate multiple reactive components 40, 42 of the well treatment stimulant from each other.

The matrix material 36 of the coating 34 may be dissolvable. The coating 34 can prevent plugging of a filter portion 24 of the well screen assembly 12 during installation and expansion of the well screen assembly 12 in a well.

The well treatment stimulant may generate gas and/or heat when multiple reactive components 40, 42 of the well treatment stimulant react with each other.

The well treatment stimulant can comprise multiple reactive components 40, 42, with the reactive components comprising $NaNO_2$ and $NH_4Cl$.

The well treatment substance 38 may comprise a permeability increaser and/or a mud cake dissolver.

The well screen assembly 12 may be expandable radially outward in a well. The well treatment substance may be secured to an outwardly extendable portion of the well screen assembly 12.

Also described by the above disclosure is a method of treating a well. The method can include expanding a well screen assembly 12 outward in a wellbore 14 of the well, thereby decreasing a distance between a well treatment substance 38 and a wall 20 of the wellbore 14. This distance decreasing can include bringing the well treatment substance into direct contact with the wall of the wellbore.

The method can include incorporating the well treatment substance 38 into the well screen assembly 12.

The method can include incorporating at least one reactive component 40 of a well treatment stimulant into the well screen assembly 12.

The method can include dissolving a matrix material 36 of the coating 34 in the well. The dissolving step may be performed before, during and/or after expanding the well screen assembly 12.

The coating 34 preferably prevents plugging of a filter portion 24 of the well screen assembly 12 during installation and expansion of the well screen assembly 12 in the well.

The above disclosure also describes a method of treating a well, with the method including the step of contacting multiple reactive components 40, 42 of a well treatment stimulant with each other in the well, thereby dispersing a well treatment substance 38 about a well screen assembly 12.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well screen assembly, comprising:

a well treatment substance secured to the well screen assembly; and at least one reactive component of a well treatment stimulant, the at least one reactive component being secured to the well screen assembly, wherein the well treatment substance and the reactive component are incorporated into a coating applied to the well screen assembly, and wherein the coating prevents plugging of a filter portion of the well screen assembly during expansion of the well screen assembly in a well.

2. The well screen assembly of claim 1, wherein a matrix material of the coating isolates multiple reactive components of the well treatment stimulant from each other.

3. The well screen assembly of claim 1, wherein a matrix material of the coating is dissolvable.

4. The well screen assembly of claim 1, wherein the coating prevents plugging of a filter portion of the well screen assembly during installation of the well screen assembly in a well.

5. The well screen assembly of claim 1, wherein the well treatment substance comprises a mud cake dissolver.

6. The well screen assembly of claim 1, wherein the well screen assembly is expandable radially outward in a well.

7. The well screen assembly of claim 1, wherein the well treatment substance is secured to an outwardly extendable portion of the well screen assembly.

8. A well screen assembly, comprising:

a well treatment substance secured to the well screen assembly; and at least one reactive component of a well treatment stimulant, the at least one reactive component being secured to the well screen assembly, wherein the well treatment stimulant generates gas when multiple reactive components of the well treatment stimulant react with each other.

9. A well screen assembly, comprising:

a well treatment substance secured to the well screen assembly; and at least one reactive component of a well treatment stimulant, the at least one reactive component being secured to the well screen assembly, wherein the well treatment stimulant generates heat when multiple reactive components of the well treatment stimulant react with each other.

10. A well screen assembly, comprising:

a well treatment substance secured to the well screen assembly; and at least one reactive component of a well treatment stimulant, the at least one reactive component being secured to the well screen assembly, wherein the well treatment stimulant comprises multiple reactive components, the reactive components comprising $NaNO_2$ and $NH_4Cl$.

11. A well screen assembly, comprising:

a well treatment substance secured to the well screen assembly; and at least one reactive component of a well treatment stimulant, the at least one reactive component being secured to the well screen assembly, wherein the well treatment substance comprises a permeability increaser.

12. A method of treating a well, the method comprising the step of:

expanding a well screen assembly outward in a wellbore of the well, thereby decreasing a distance between a wall of the wellbore and a coating on the well screen assembly, the coating comprising a well treatment substance.

13. The method of claim 12, wherein the well treatment substance comprises a well treatment stimulant.

14. The method of claim 12, wherein a matrix material of the coating isolates multiple reactive components of a well treatment stimulant from each other.

15. The method of claim 12, further comprising the step of dissolving a matrix material of the coating in the well.

16. The method of claim 15, wherein the dissolving step is performed after the expanding step.

17. The method of claim 15, wherein the dissolving step is performed during the expanding step.

18. The method of claim 15, wherein the dissolving step is performed before the expanding step.

19. The method of claim 12, wherein the coating prevents plugging of a filter portion of the well screen assembly during installation of the well screen assembly in the well.

20. The method of claim 12, wherein the coating prevents plugging of a filter portion of the well screen assembly during expansion of the well screen assembly in the well.

21. The method of claim 12, wherein the well treatment substance comprises a mud cake dissolver.

22. A method of treating a well, the method comprising the steps of:

expanding a well screen assembly outward in a wellbore of the well, thereby decreasing a distance between a well treatment substance and a wall of the wellbore; and incorporating the well treatment substance into the well screen assembly, wherein the incorporating step comprises incorporating at least one reactive component of a well treatment stimulant into the well screen assembly, and wherein the well treatment stimulant generates gas when multiple reactive components of the well treatment stimulant react with each other.

23. A method of treating a well, the method comprising the steps of:

expanding a well screen assembly outward in a wellbore of the well, thereby decreasing a distance between a well treatment substance and a wall of the wellbore; and incorporating the well treatment substance into the well screen assembly, wherein the incorporating step comprises incorporating at least one reactive component of a well treatment stimulant into the well screen assembly, and wherein the well treatment stimulant generates heat when multiple reactive components of the well treatment stimulant react with each other.

24. A method of treating a well, the method comprising the steps of:

expanding a well screen assembly outward in a wellbore of the well, thereby decreasing a distance between a well treatment substance and a wall of the wellbore; and incorporating the well treatment substance into the well screen assembly, wherein the incorporating step comprises incorporating at least one reactive component of a well treatment stimulant into the well screen assembly, and wherein the well treatment stimulant comprises multiple reactive components, the reactive components comprising $NaNO_2$ and $NH_4Cl$.

25. A method of treating a well, the method comprising the steps of:

expanding a well screen assembly outward in a wellbore of the well, thereby decreasing a distance between a well treatment substance and a wall of the wellbore, wherein the well treatment substance comprises a permeability increaser.

26. A method of treating a well, the method comprising the step of:

incorporating a well treatment substance and at least one reactive component into a coating applied to a well screen assembly;

then installing the well screen assembly in the well;

then injecting a well treatment stimulant into the well; and contacting the at least one reactive component with the well treatment stimulant in the well, thereby dispersing the well treatment substance about the well screen assembly.

27. The method of claim 26, wherein the at least one reactive component comprises multiple reactive components.

28. The method of claim 27, wherein a matrix material of the coating isolates the multiple reactive components from each other.

29. The method of claim 26, wherein the well treatment stimulant dissolves a matrix material of the coating in the well.

30. The method of claim 26, wherein the coating prevents plugging of a filter portion of the well screen assembly during installation of the well screen assembly in the well.

31. The method of claim 26, wherein the coating prevents plugging of a filter portion of the well screen assembly during expansion of the well screen assembly in the well.

32. The method of claim 26, wherein gas is generated when the well treatment stimulant contacts the at least one reactive component.

33. The method of claim 26, wherein heat is generated when the well treatment stimulant contacts the at least one reactive component.

34. The method of claim 26, wherein the at least one reactive component comprises one of $NaNO_2$ and $NH_4Cl$.

35. The method of claim 26, wherein the well treatment substance comprises a permeability increaser.

36. The method of claim 26, wherein the well treatment substance comprises a mud cake dissolver.

37. The method of claim 26, further comprising the step of expanding the well screen assembly outward in a wellbore of the well, thereby decreasing a distance between the well treatment substance and a wall of the wellbore.

38. The method of claim 26, wherein the coating is secured to an outwardly extendable portion of the well screen assembly.

* * * * *